US006723206B1

(12) United States Patent
Fransson et al.

(10) Patent No.: US 6,723,206 B1
(45) Date of Patent: Apr. 20, 2004

(54) METHOD OF THREADING

(75) Inventors: Tommy Fransson, Växjö (SE); Evert Nilsson, Ingelstad (SE)

(73) Assignee: Andritz Technology and Asset Management GmbH, Graz (AT)

( * ) Notice: Subject to any disclaimer, the term of this patent is extended or adjusted under 35 U.S.C. 154(b) by 49 days.

(21) Appl. No.: 10/018,778

(22) PCT Filed: Jun. 16, 2000

(86) PCT No.: PCT/SE00/01263

§ 371 (c)(1),
(2), (4) Date: Dec. 21, 2001

(87) PCT Pub. No.: WO01/00516

PCT Pub. Date: Jan. 4, 2001

(30) Foreign Application Priority Data

Jun. 30, 1999 (SE) ..... 9902480

(51) Int. Cl.[7] ..... D21F 1/36

(52) U.S. Cl. ..... 162/193; 162/255; 226/12; 34/648

(58) Field of Search ..... 162/193, 194, 162/195, 252, 253, 263, 272, 198, 199, 255, 283, 286; 226/12, 91, 92; 34/117, 120, 613, 648, 556, 445–447; 242/562.1, 364.4, 532.7, 332, 332.1, 332.2, 413

(56) References Cited

U.S. PATENT DOCUMENTS 3,510,036 A * 5/1970 Lewis, Jr. et al. ..... 226/2
5,158,648 A 10/1992 Weldon
5,234,549 A * 8/1993 Weldon ..... 162/193
5,298,121 A * 3/1994 Kilmister ..... 162/198
6,395,135 B1 * 5/2002 Kojo et al. ..... 162/193

FOREIGN PATENT DOCUMENTS

CA 2209882 1/1998
JP 2000-96483 * 4/2000 ..... D21F/7/04

* cited by examiner

*Primary Examiner*—Steven P. Griffin
*Assistant Examiner*—Eric Hug
(74) *Attorney, Agent, or Firm*—Burns, Doane, Swecker & Mathis, L.L.P.

(57) ABSTRACT

A method for threading a material web (3) through a processing plant (1). The material web (3) is divided, by a longitudinal cut, into a first narrow part (31) and a second broad part (32), the first part (31) being passed through the processing plant (1) while the second part (32) is separated. The width of the first part (31) is increased successively so that a growing share of the material web (3) is passed through the processing plant (1). Finally the entire width of the material web (3) is passed through the processing plant (1). The material web (3) is pulled through the processing plant (1) by a controllable force (tension). The magnitude of the controllable force is automatically adjusted to the width of the first part (31) of the material web (3), preferably in such manner that the magnitude of the force is selected proportional to the width of the first part (31).

32 Claims, 1 Drawing Sheet

METHOD OF THREADING

FIELD OF THE INVENTION

The present invention relates to a method for threading a material web through a processing plant.

The method is specifically adapted for threading a material web through a processing plant, in which the material web, in alternating directions, passes through two or more decks, and in particular when the processing plant is adapted to tension the material web by regulating the speed of one or more conveying cylinders so that somehow established tractive force is transferred to the material web.

BACKGROUND ART

Material webs, such as pulp webs or paper webs, are in technical contexts processed with widths of several meters and at considerable web speeds. Moreover, transfer often occurs between two or more processing steps, in which an accurate control is necessary to prevent operational disorder.

Especially when starting operation, the transfer between processing steps is a most critical point. When transferring a material web between two processing steps, one therefore usually begins with a narrow strip at one edge of the material web, a so-called leader. The leader is pulled through the processing step and then the width of the material to be processed is successively increased until finally the entire width is reached. The part separated during the threading is rejected or recycled for reworking.

If the processing plant comprises more than two steps, the threading process must be repeated in each transition. This means that the reliability and speed of a threading method is most important to efficiency and economic yield. Each failure costs a lot of money.

Originally the width of the leader is purposely very small relative to the full width of the material web. As the successive increase of the width proceeds, it may during the threading, in one and the same processing step, be a web of material with a width from e.g. 0.1 m to 6 m. This means that the force by which the web is pulled through the processing step must be controlled most accurately. The length of the web in a processing step can, e.g. in paper and pulp dryers, be several hundreds of meters. However, the critical point is where the web enters a drier since the low dry solids content then gives the lowest strength.

One example of a close prior-art method is described in U.S. pat. No. 5,158,648. This publication describes in detail the established technique using an edge strip in connection with threading and the drawbacks involved therein. As an improvement it is suggested that the web be broadened symmetrically starting from a central point. To this end, use is made of two knives which are freely movable over the width of the web. This is said to prevent lateral movement and flapping of the web.

An operator monitors the process and controls the retrieval of slack and regulates the tension of the web.

OBJECT OF THE INVENTION

An object of the invention is to provide a quick and reliable method for threading a material web.

In particular the invention aims at providing a quick and reliable method for threading in transferring a web of pulp from the wet end to a dryer when manufac- turing paper-making pulp and in transferring a paper web from the wet end to a dryer when making paper.

SUMMARY OF THE INVENTION

The present invention relates to a method for threading a material web through a processing plant. The material web is divided, by a longitudinal cut, into a first narrow part and a second broad part, the first part being passed through the processing plant while the second part is separated. The width of the first part is successively increased so that a growing share of the web-shaped material is passed through the processing plant. Finally, the entire width of the material web is passed through the processing plant. The material web is pulled through the processing plant by a controllable force (tension).

In the method according to the invention, the magni- tude of the controllable force is automatically adjusted to the width of the first part of the material web, preferably so that the magnitude of the force is selected proportional to the width of the first part.

GENERAL DESCRIPTION OF THE INVENTION

When threading a material web through a processing plant, the web is divided, by a longitudinal cut, into a first narrow part and a second broad part, the first part being passed through the processing plant while the second part is separated. The width of the first part is successively increased so that a growing share of the material web is passed through the processing plant. This is a critical phase in the production of, for example, paper. The risk of repeated breaks of the web with the ensuing long down- times is obvious. The conventional method of controlling the force by which the leader is pulled through the dryer is that an operator first performs the retrieval of the slack forming on the occasion of starting and subsequent- ly manually increases the tractive force in the web, the so-called web tension, so that the web is kept suffi- ciently tensioned but is not subjected to such stress as results in web break.

According to the present invention it is suggested that the magnitude of the controllable force that pulls the web through the dryer be automatically adjusted to the width of the first part, the leader, of the material web. This should in the first place occur in such manner that the magnitude of the force is selected proportional to the width of the first part.

The preferred principle is that the magnitude of the force is adjusted proportional to the width of the web when entering the dryer. This can be carried out, for example, by synchronous control of the position of the knife dividing the web and the tractive force giving the tension to the web. A further possibility is that the width of the web is measured in the vicinity of the web entering the dryer and that this measured valve is allow- ed to control the tractive force.

After an initial interval with an essentially con- stant width the width of that part which is passed through the processing plant is successively increased. That may occur continuously, but occurs suitably through at least two monotonously growing phases with an interme- diate interval with an essentially constant width, pre- ferably through three or more monotonously growing phases with intermediate intervals with essentially constant widths.

If the material web, in alternating directions, passes through two or more decks, the length of the intermediate interval or intervals should exceed the length of the web located in an individual deck, Suitably the length of the intermediate interval or intervals is smaller than twice the length of the web located in an individual deck. The length of at least one monotonously growing phase should be smaller than the length of the web located in an individual deck. In a preferred embodiment, the length of each of two or more monotonously growing phases, preferably the first phases, is smaller than the length of the web located in an individual deck.

The width of the first part during the initial interval should be 50-200 mm, preferably about 100 mm.

The width of the first part during one or more monotonously growing phases should be increased by a factor 2 to 5.

BRIEF DESCRIPTION OF THE FIGURES

The invention will now be described in more detail with reference to the accompanying drawing, in which.

DESCRIPTION OF A PREFERRED EMBODIMENT

Figure 1:
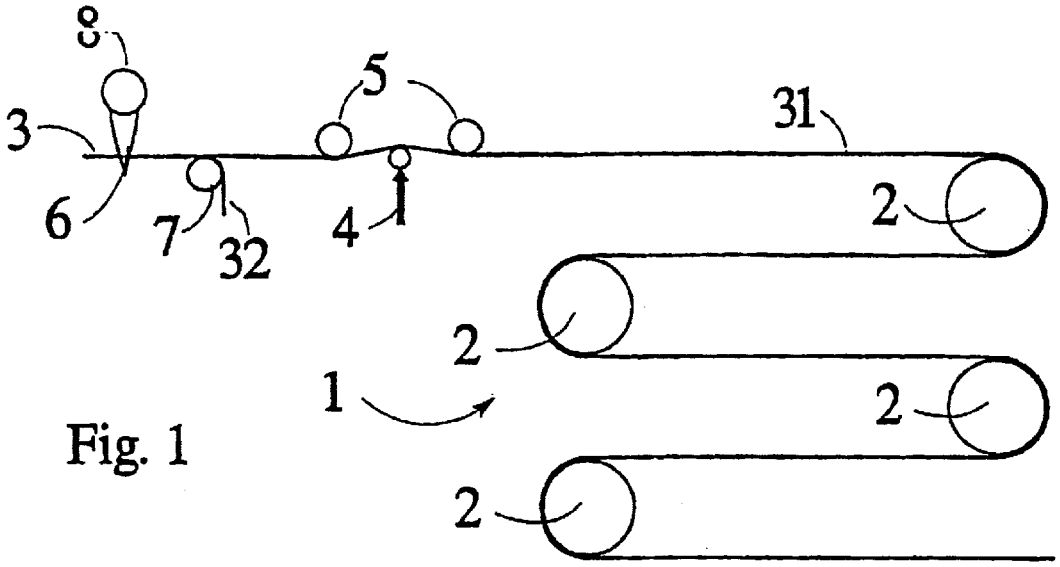
FIG. 1 is a schematic side view of a pulp dryer according to the invention.

FIG. 1 illustrates a simplified design of a pulp dryer 1 comprising four driven turning rolls 2 over which a pulp web 3 is passed. At the inlet of the dryer 1, a movable knife 6 and a deflecting roll 7 are arranged, followed by a load sensing means 4 between two supporting rolls 5. The knife 6 can be moved transversely to an arbitrary position along a positioning means 8.

Figure 2:
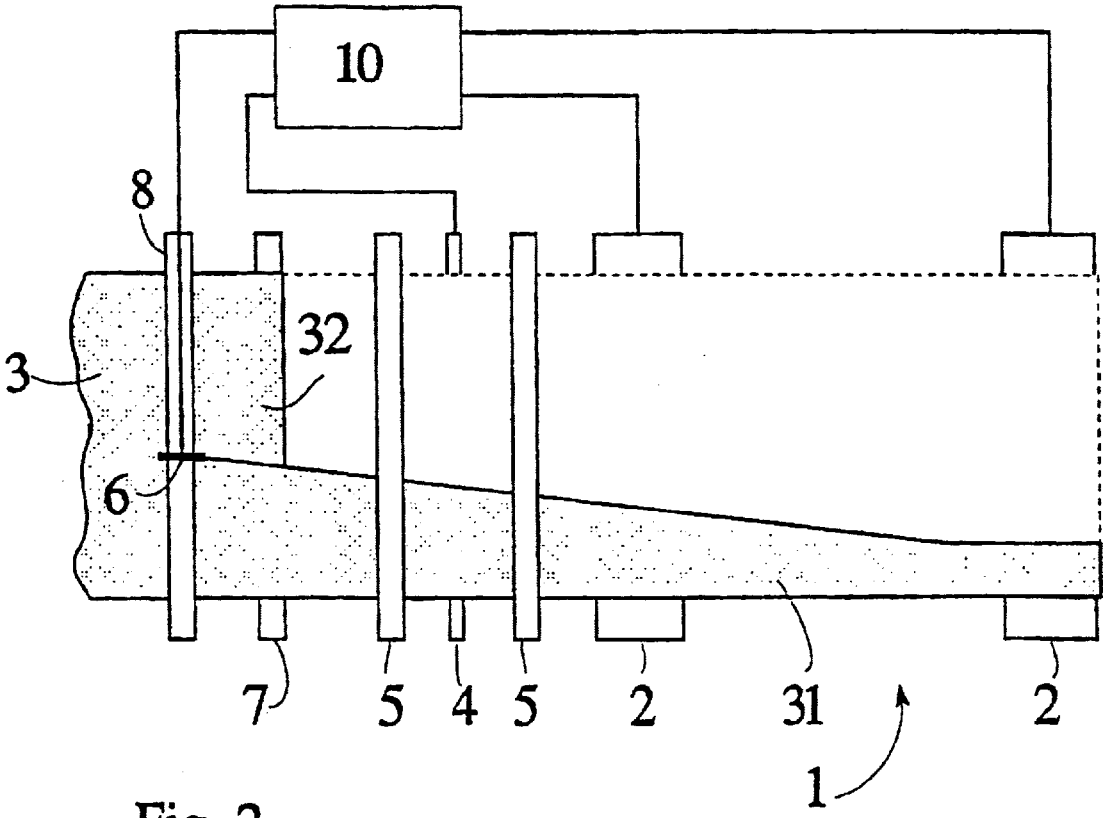
FIG. 2 is a schematic top view of the same pulp dryer according to the invention.

FIG. 2 is a top view of the same pulp dryer 1. Where applicable, the reference numerals are the same. In addition, a control unit 10 is illustrated, which is connected to the positioning means 8, the load sensing means 4 and the driving devices for the turning rolls 2.

The pulp web 3 is divided by means of the knife 6 into a leader 31 which is passed through the dryer 1, and a second part 32 which via the deflecting roll 7 is sepa- rated and recirculated to the forming station (not shown) of the pulp web. The control unit 10 controls the posi- tion of the knife 6 with the aid of the positioning means 8 so that the desired width of the leader 31 is obtained. The control unit 10 also controls the driving devices for the turning rolls 2, so that the load sensing means 4 registers a predetermined force in the web 3 (web ten- sion).

By means of a threading belt (act shown) a narrow leader 31 is first introduced into the dryer 1. Subsequently, the leader 31 is successively widened according to a predetermined programme so that finally the entire web 3 is passed through the dryer 1. The control unit 10 controls the driving of the turning rolls 2 so that the force in the web (web tension) grows proportionally to the width of the leader 31 at the inlet of the dryer 1. Preferably, this takes place by synchronous control of the position of the knife 6 and the desired value of the load sensing means 4.

What is claimed is:

1. A method for threading a material web through a processing plant, in which the material web is divided by a longitudinal cut into a first narrow part and a second broad part, the first part being passed through the processing plant while the second part is separated, the width of the first part is increased successively so that a growing share of the material web is passed through the processing plant, so that finally the the entire width of the material web is passed through the processing plant, and the material web is pulled through the processing plant by a controllable force, wherein the successive increase of the width of that part which is passed through the processing plant is preceded by an initial interval with an essentially constant width, wherein the successive increase of the width of that part which is passed through the processing plant occurs through at least two monotonously growing phases with an intermediate interval with an essentially constant width, and wherein the magnitude of the controllable force is automatically adjusted to the width of the first part of the material web.

2. A method according to claim 1, wherein the width of the first part during the initial interval is 50–200 mm.

3. A method according to claim 1, wherein the width of the first part during one or more monotonously growing phases is increased by a factor of 2 to 5.

4. A method as claimed in claim 1, wherein the material web, in alternating directions, passes through two or more decks, and the length of at least one of the intermediate intervals exceeds the length of the material web located in an individual deck.

5. A method according to claim 4, wherein the length of the at least one intermediate interval is smaller than twice the length of the material web located in an individual deck.

6. A method according to claim 5, wherein the length of each of the at least two monotonously growing phases is smaller than the length of the material web located in an individual deck.

7. A method as claimed in claim 1, wherein the material web, in alternating directions, passes through two or more decks, and the successive increase of the width of that part which is passed through the processing plant occurs through three or more monotonously growing phases with intermediate intervals with essentially constant widths, and the length of the intermediate intervals exceeds the length of the material web located in an individual deck.

8. A method according to claim 7, wherein the length of the intermediate intervals is smaller than twice the length of the material web located in an individual deck.

9. A method according to claim 8, wherein the length of each of the two first monotonously growing phases is smaller than the length of the material web located in an individual deck.

10. A method according to claim 1, wherein the magnitude of the controllable force is automatically adjusted to the width of the first part of the material web when entering the processing plant.

11. A method according to claim 4, wherein the magnitude of the controllable force is automatically adjusted to the width of the first part of the material web when entering the processing plant.

12. A method according to claim 5, wherein the magnitude of the controllable force is automatically adjusted to the width of the first part of the material web when entering the processing plant.

13. A method according to claim 6, wherein the magnitude of the controllable force is automatically adjusted to the width of the first part of the material web when entering the processing plant.

14. A method according to claim 7, wherein the magnitude of the controllable force is automatically adjusted to the width of the first part of the material web when entering the processing plant.

15. A method according to claim 8, wherein the magnitude of the controllable force is automatically adjusted to the width of the first part of the material web when entering the processing plant.

16. A method according to claim 9, wherein the magnitude of the controllable force is automatically adjusted to the width of the first part of the material web when entering the processing plant.

17. A method according to claim 1, wherein the magnitude of the controllable force is selected proportional to the width of the first part.

18. A method according to claim 4, wherein the magnitude of the controllable force is selected proportional to the width of the first part.

19. A method according to claim 5, wherein the magnitude of the controllable force is selected proportional to the width of the first part.

20. A method according to claim 6, wherein the magnitude of the controllable force is selected proportional to the width of the first part.

21. A method according to claim 7, wherein the magnitude of the controllable force is selected proportional to the width of the first part.

22. A method according to claim 8, wherein the magnitude of the controllable force is selected proportional to the width of the first part.

23. A method according to claim 9, wherein the magnitude of the controllable force is selected proportional to the width of the first part.

24. A method according to claim 1, wherein the magnitude of the force is selected proportional to the width of the first part where the longitudinal cut is made.

25. A method according to claim 4, wherein the magnitude of the force is selected proportional to the width of the first part where the longitudinal cut is made.

26. A method according to claim 5, wherein the magnitude of the force is selected proportional to the width of the first part where the longitudinal cut is made.

27. A method according to claim 6, wherein the magnitude of the force is selected proportional to the width of the first part where the longitudinal cut is made.

28. A method according to claim 7, wherein the magnitude of the force is selected proportional to the width of the first part where the longitudinal cut is made.

29. A method according to claim 8, wherein the magnitude of the force is selected proportional to the width of the first part where the longitudinal cut is made.

30. A method according to claim 9, wherein the magnitude of the force is selected proportional to the width of the first part where the longitudinal cut is made.

31. A method for threading a material web through a processing plant, in which the material web is divided by a longitudinal cut into a first narrow part and a second broad part, the first part being passed through the processing plant while the second part is separated, the width of the first part is increased successively so that a growing share of the material web is passed through the processing plant, so that finally the entire width of the material web is passed through the processing plant, and the material web is pulled through the processing plant by a controllable force, the magnitude of the controllable force being automatically adjusted to the width of the first pant of the material web, wherein the material web, in alternating directions, passed through two or more decks, and wherein the length of at least one intermediate interval exceeds the length of the material web located in an individual deck, and the length of the at least one intermediate interval is smaller than twice the length of the material web located in an individual deck.

32. A method for threading a material web through a processing plant, in which the material web is divided by a longitudinal cut into a first narrow part and a second broad part, the first part being passed through the processing plant while the second part is separated, the width of the first part is increased successively so that at growing share of the material web is passed through the processing plant, so that finally the entire width of the material web is passed through the processing plant, and the material web is pulled through the processing plant by a controllable force, the magnitude of the controllable force being automatically adjusted to the width of the first part of the material web, wherein the length of each of two or more monotonously growing phases is smaller than the length of the material web located in an individual deck.

* * * * *